US005951003A

United States Patent [19]

Nojima et al.

[11] Patent Number: 5,951,003

[45] Date of Patent: Sep. 14, 1999

[54] SHEET SUPPLY APPARATUS HAVING AN INVERTED V-SHAPED SEPARATION PAD

[75] Inventors: Takashi Nojima, Mitaka; Soichi Hiramatsu, Hachioji; Hideki Yamaguchi, Yokohama; Hiroyuki Inoue, Yokohama; Hitoshi Nakamura, Yokohama; Akira Kida, Yokohama; Hideaki Kawakami, Yokohama; Takeshi Iwasaki, Yokohama, all of Japan

[73] Assignee: Canon Kabushiki Kaisha, Tokyo, Japan

[21] Appl. No.: 08/980,209

[22] Filed: Nov. 28, 1997

Related U.S. Application Data

[63] Continuation of application No. 08/603,372, Feb. 20, 1996, abandoned.

[30] Foreign Application Priority Data

Feb. 21, 1995 [JP] Japan ..... 7-032193

[51] Int. Cl.[6] ..... B65H 3/52

[52] U.S. Cl. ..... 271/121; 271/126; 271/167

[58] Field of Search ..... 271/119, 121, 271/126, 127, 167

[56] References Cited

U.S. PATENT DOCUMENTS

| | | | |
|---|---|---|---|
| 3,687,448 | 8/1972 | Vora | 271/21 |
| 4,089,516 | 5/1978 | Colglazier et al. | 271/9 |
| 4,635,922 | 1/1987 | Roetter et al. | 271/121 X |
| 4,815,724 | 3/1989 | Sumida et al. | 271/121 |
| 5,026,042 | 6/1991 | Miller | 271/127 |
| 5,183,248 | 2/1993 | Okada et al. | 271/121 X |
| 5,316,285 | 5/1994 | Olson et al. | 271/121 X |
| 5,437,444 | 8/1995 | Kawakami et al. | 271/22 |

FOREIGN PATENT DOCUMENTS

| | | | |
|---|---|---|---|
| 409153 | 1/1991 | European Pat. Off. | 271/121 |
| 2164369 | 7/1972 | Germany . | |
| 55038 | 3/1986 | Japan | 271/121 |
| 249841 | 10/1987 | Japan | 271/121 |
| 104537 | 4/1989 | Japan | 271/121 |
| 321230 | 12/1989 | Japan | 271/121 |
| 4256638 | 9/1992 | Japan . | |
| 5278883 | 10/1993 | Japan . | |

*Primary Examiner*—Boris Milef
*Attorney, Agent, or Firm*—Fitzpatrick Cella Harper & Scinto

[57] ABSTRACT

A sheet supply apparatus is provided having a pressure plate for supporting sheets on a sheet supporting surface, a pick-up roller for feeding out the sheets supported by the pressure plate, a plate member for separating the sheets fed out by the pick-up roller one by one, and a separation pad provided on the sheet supporting surface of the pressure plate opposite the pick-up roller. The separation pad protrudes from the sheet supporting surface toward the sheets to contact frictionally the lower surface of the bottom-most sheet supported by the pressure plate. The separation pad has an upper surface which is higher at a portion opposing the pick-up roller than a portion downstream thereof, in a sheet feeding direction, relative to the sheet supporting surface of the pressure plate, to urge an end of a sheet fed out by the pick-up roller toward the pressure plate.

14 Claims, 13 Drawing Sheets

SHEET SUPPLY APPARATUS HAVING AN INVERTED V-SHAPED SEPARATION PAD

This application is a continuation of application Ser. No. 08/603,372 filed Feb. 20, 1996, which is now abandoned.

BACKGROUND OF THE INVENTION

1. Field of the Invention

The present invention relates to a sheet supply apparatus for supplying a sheet (for example, printing sheet, transfer sheet, photosensitive sheet, electrostatic recording sheet, print sheet, OHP sheet, envelope, post card, sheet original and the like) from a sheet stacking portion to a sheet treating portion (for example, recording portion, reading portion, working portion and the like) in an image forming apparatus such as a recording device, i.e., a printer (as an information output device of a word processor, a personal computer and the like), a copying machine, a facsimile machine and the like, and a recording apparatus having such a sheet supply apparatus.

2. Related Background Art

In sheet supply apparatuses, it is required that stacked sheets are surely separated one by one and the separated sheet is positively supplied. In the past, there has been proposed a technique in which a pawl member is provided in association with a front corner of a sheet stack so that, when sheets are fed out by a sheet supply roller, only an uppermost sheet is flexed to ride over the pawl member, thereby separating the sheets one by one. However, in this technique, sheets having great resiliency (hard to be flexed) such as envelopes, post cards and the like cannot surely be separated one by one.

On the other hand, there has been proposed a technique in which sheets hard to be flexed (for example, envelopes, post cards and the like) can be separated one by one (see Japanese Patent Appln. Laid-Open No. 3-284547). This technique will now be explained with reference to FIG. 11. A sheet stacking plate 201 for stacking sheets thereon is biased upwardly by a spring member 203. A free roller 204 for regulating an upper surface of the sheet stack is contacted with an upper surface of the sheet stack on the sheet stacking plate 201 to maintain the upper surface of the sheet stack below a guide surface 205. Further, an inclined surface 207 for separating sheets is disposed at a downstream side of the sheet stacking plate 201.

A sheet supply roller 206 is constituted by a semi-circular roller having a large diameter portion and a small diameter portion (cut-out portion) so that, when the large diameter portion of the sheet supply roller is urged against an upper surface of the sheet stack on the sheet stacking plate 201, one or several sheets are fed out. The sheets fed out by the sheet supply roller 206 abut against the inclined surface 207. In this case, an uppermost sheet rides over the inclined surface 207 while being flexed, thereby separating the uppermost sheet from the other sheet(s). Since tip ends of second and other sheets are pressed downwardly by an elastic force of the flexed uppermost sheet, these sheets cannot ride over the inclined surface 207. In this way, the sheets are positively separated one by one.

However, in such a separating mechanism, since the elastic force generated in the uppermost sheet when the uppermost sheet is flexed around a contact point P between the sheet and the free roller 204 acts on the tip ends of the second and other sheets and affects a great influence upon the separation of the sheets, the inclination of the inclined surface 207 must be set in accordance with the flexural rigidity of the sheet. That is to say, when the sheets having great flexural rigidity are separated, the inclination of the inclined surface must be set smaller so that the fed out sheet is not deformed or folded; whereas, when the sheets having small flexural rigidity are separated, the inclination of the inclined surface must be set greater so that the second and other sheets can be fully held by the elastic force of the flexed uppermost sheet.

Accordingly, when the inclination of the inclined surface 207 is set greater to separate the sheets (for example, envelopes, post cards and the like) having great flexural rigidity, for example, when copying sheets having a weight of 60–100 g/m$^2$ try to be separated, the second and other sheets cannot be adequately held by the elastic force of the flexed uppermost sheet, with the result that the double-feed of sheets may occur. Thus, such an inclined surface cannot be used for the sheet having small flexural rigidity (such as plain sheet).

To avoid this, there has been proposed a technique in which both sheets having different flexural rigidities can be separated by a single separation means. Now, this technique will be explained with reference to FIG. 12. A sheet stacking plate 301 on which sheets are stacked as a sheet stack is biased upwardly by a spring 302 so that, when a sheet supply roller 303 is contacted with an uppermost sheet in the sheet stack, several sheets are fed out by rotation of the sheet supply roller.

An elastically deformable plate member 305 is disposed at a position where tip ends of the stacked sheets is regulated. The plate member 305 is formed from a plastic film or a metallic spring plate having predetermined flexural rigidity and can be elastically deformed when the sheets fed out by the sheet supply roller 303 abuts against the plate member.

When the sheet supply roller 303 is rotated and the sheet stack on the stacking plate 302 is urged against the sheet supply roller 303 by a force of the spring 302 (upon releasing the sheet stacking plate by a release means (not shown)), the plate member is greatly flexed by the tip ends of the driven sheets. In this condition, the tip end of the uppermost sheet rides over the plate member while sliding on the latter, thereby separating the uppermost sheet from the other sheets. With this arrangement, various sheets having different rigidities can be separated.

Incidentally, separation pads 306 for generating a double-feed preventing force by contacting with a last sheet are provided on a sheet stacking surface of the sheet stacking plate 302. The separation pads 306 are normally formed from elastic material such as rubber, artificial leather or the like.

However, in the sheet supply apparatus having the construction shown in FIG. 12, when the sheet supply roller 303 is rotated, the separation pads 306 may be elastically deformed to float. If the separation pads are deformed in this way, as shown in FIG. 13, the tip ends of the sheets are lifted, with the result that the deforming start position of the plate member 305 is elevated. In the separating method using the plate member 305, since the sheets are separated by controlling the elasticity of the plate member 305, if the deforming start position is elevated, an amount of deformation of the plate member 305 is increased, with the result that two or more sheets may ride over the plate member simultaneously, thereby causing the double-feed.

Further, even if the separation pads 306 are formed from material which is hard to be elastically deformed, due to inaccurate parallelism of the sheet stacking surface of the sheet stacking plate 302 and/or dispersion in thickness of the separation pads 306, the above-mentioned phenomenon (floating of the separation pad or pads) may occur, thereby causing the double-feed. Thus, this attempt is still unsatisfactory.

SUMMARY OF THE INVENTION

The present invention aims to eliminate the above-mentioned conventional drawbacks, and an object of the present invention is to positively prevent double-feed of sheets due to deformation of separation pad or pads provided on a sheet stacking plate.

To achieve the above object, according to the present invention, there is provided a sheet supply apparatus comprising a sheet stacking means for stacking sheets, a sheet supply means for feeding out the sheets stacked on the sheet stacking means, a separation means for separating the sheets fed out by the sheet supply means one by one, and a friction separation pad means provided on a sheet stacking surface of the sheet stacking means in a confronting relation to the sheet supply means. Wherein the separation pad means is so shaped that a surface of the separation pad means opposed to the sheet supply means has an upstream side high level surface portion and a downstream side low level portion in a sheet supplying direction.

The present invention further provides a recording apparatus comprising a sheet stacking means for stacking sheets, a sheet supply means for feeding out the sheets stacked on the sheet stacking means, a separation means for separating the sheets fed out by the sheet supply means one by one, a recording means for executing recording on the sheet separated by the separation means, and a friction separation pad means provided on a sheet stacking surface of the sheet stacking means in a confronting relation to the sheet supply means. Wherein the separation pad means is so shaped that a surface of the separation pad means opposed to the sheet supply means has an upstream side high level surface portion and a downstream side low level portion in a sheet supplying direction.

With the arrangement as mentioned above, when the sheets stacked on the sheet stacking means are fed out by the sheet supply means, due to the configuration of the separation pad means, downstream ends of the sheets are not floating, with the result that the sheets can be sent to a proper position of the separation means. Thus, the poor separation of the separation means can be reduced.

Further, when a contact width between the separation pad means and the sheet is smaller than a width of the sheet supply means, since the separating action is generated not only by contacting the sheet with the upper surface of the separation pad means but also by contacting the sheet with side edges of the separation pad means, the apparatus can be made compact and cheaper without reducing the separating ability of the separation pad means.

DETAILED DESCRIPTION OF THE PREFERRED EMBODIMENTS

First Embodiment

Entire Construction

Figure 1:
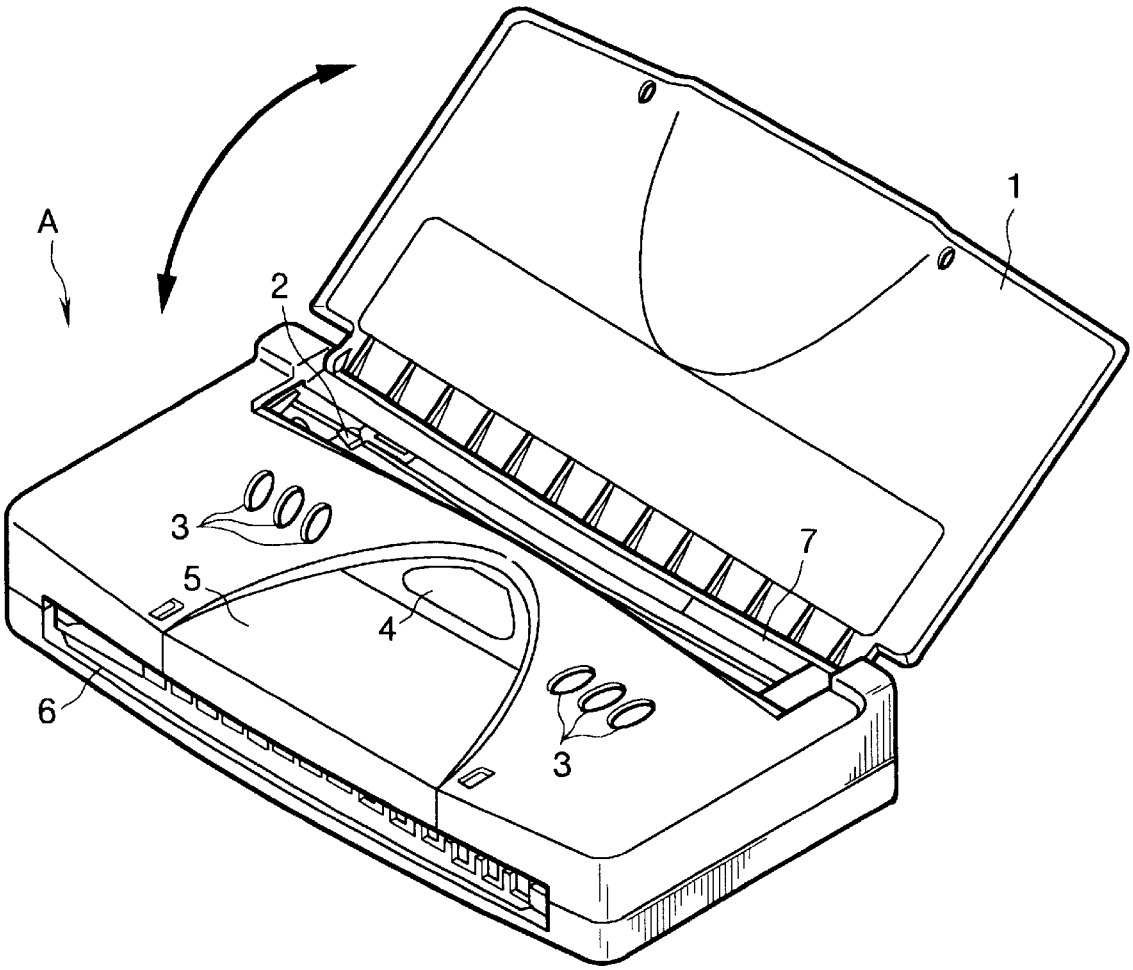
FIG. 1 is a perspective view of a recording apparatus to which a sheet supply apparatus according to the present invention is applied.

FIG. 1 is a perspective view of the entire recording apparatus A having a sheet supply apparatus B according to the present invention.

A paper tray 1 also acts as a cover of the recording apparatus A and can be rotated around a rotary shaft (not shown) in a direction shown by the double-headed arrow. In use, the paper tray 1 is opened as shown in FIG. 1. One or more sheets are set on the paper tray 1 with tip ends of the sheets being inserted into sheet supply opening 7. In this condition, the sheets are separated one by one by the sheet supply apparatus B disposed within the recording apparatus and the separated sheet is supplied to a recording portion C. A paper guide 2 can be slid left and right with predetermined friction to regulate side edges of the sheets stacked on the paper tray 1, thereby aligning the sheets.

After an image is recorded on the sheet separated and supplied to the recording portion C by the sheet supply apparatus B, the sheet is discharged out of the recording apparatus A through a discharge opening 6. Key-tops 3 for handling the recording apparatus A include tact-switches for effecting ON/OFF of a power source, a sheet supplying operation, a sheet discharging operation and the like. A display 4 serves to display a sheet operating condition, a sheet setting condition, an error mode and the like.

Sheet Supply Portion

Figure 2:
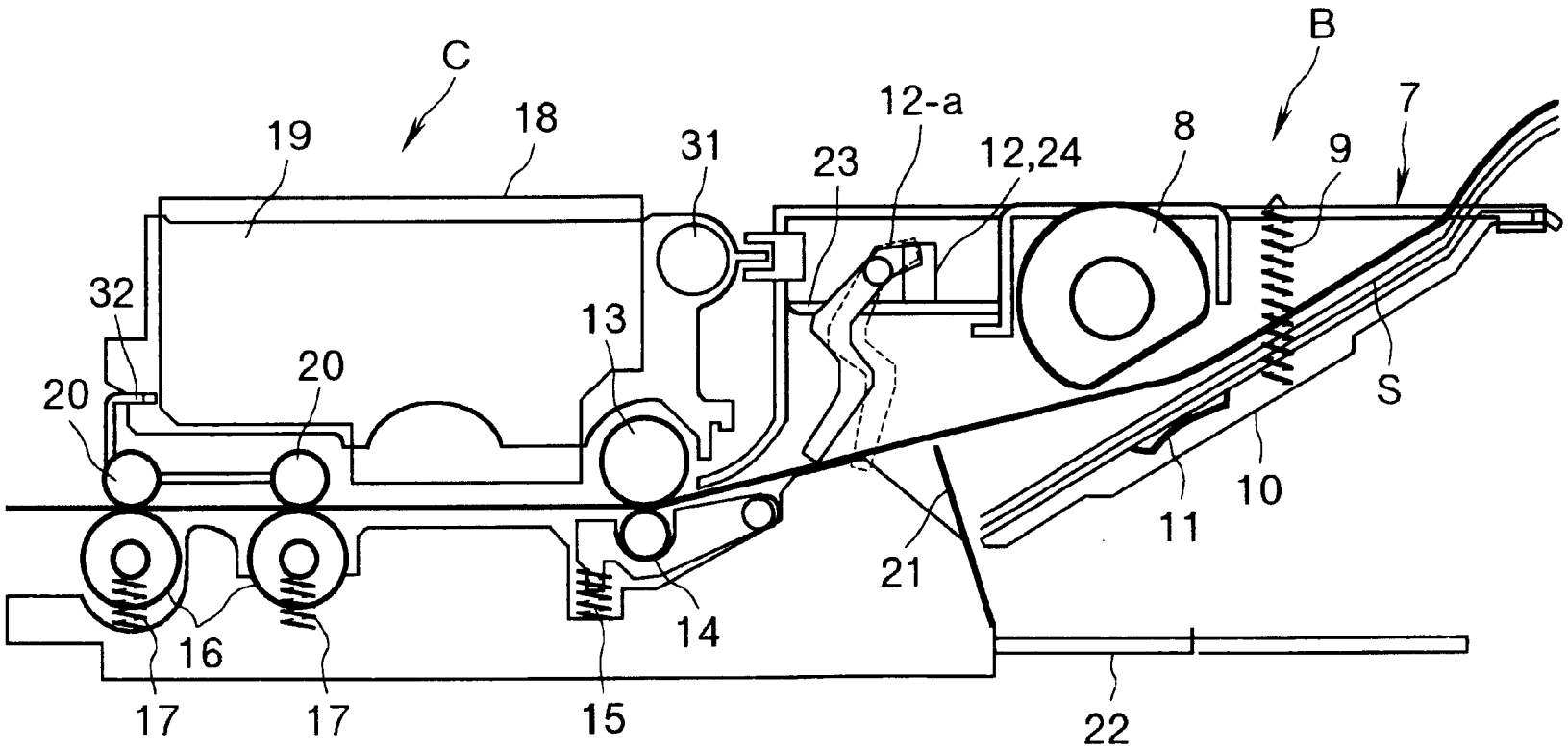
FIG. 2 is an elevational sectional view of the recording apparatus of FIG. 1.

FIG. 2 is a sectional view of the recording apparatus A. A sheet stacking means for stacking the sheets S is constituted by a pressure plate 10 which is biased upwardly (FIG. 2) by pressure springs 9. A pick-up roller (sheet supply means) 8 is disposed in a confronting relation to an uppermost sheet in the sheet stack S.

In a sheet supplying condition, the uppermost sheet in the sheet stack S on the pressure plate 10 is urged against the pick-up roller 8 by biasing forces of the pressure springs 9, so that, by rotating the pick-up roller 8, the sheets are fed out by friction. On the other hand, in a waiting condition as shown in FIG. 2, the pressure plate 10 is lowered in opposition to the biasing forces of the pressure springs 9 by means of a cam mechanism (not shown). Incidentally, the pick-up roller 8 is a so-called semi-circular roller having a cut-out portion, and, by waiting the pick-up roller in a condition as shown in FIG. 2, the sheet setting ability is improved.

A separation pad 11 having predetermined coefficient of friction is attached to a sheet stacking surface of the pressure plate 10 by adhesive and the like so that the separation pad is contacted with a lowermost sheet in the sheet stack. The coefficient of friction of the separation pad is so selected that friction coefficient $\mu$SS between the sheets becomes smaller than friction coefficient $\mu$SP between the separation pad 11 and the sheet and friction coefficient $\mu$SR between the pick-up roller 8 and the sheet becomes greater than the friction coefficient $\mu$SP. Namely, $\mu SS < \mu SP < \mu SR$ Thus, when the number of sheets stacked on the pressure plate becomes few, it is possible to prevent the double-feed phenomenon that the lowermost sheet is fed out together with the sheet being fed by the pick-up roller 8.

A separation means for separating the sheets one by one is constituted by a plate member 21. The plate member 21 is elastically deformed when it is urged by the sheets fed by the pick-up roller 8, with the result that, when the uppermost sheet ridges over the deformed plate member 21, the uppermost sheet is separated from the other sheets. Incidentally, the plate member 21 is formed from synthetic resin film such as Myler.

Now, the separation pad 11 will be fully explained with reference to FIGS. 3 and 4.

Figure 3:
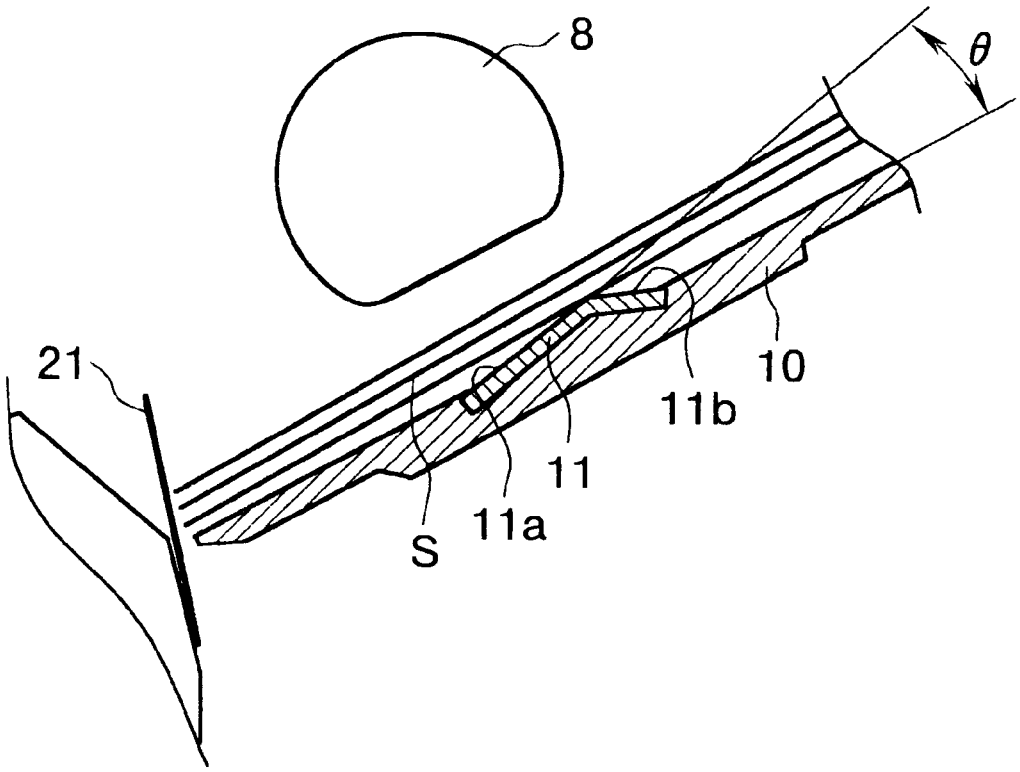
FIG. 3 is a sectional view showing a condition that a separation pad according to a main part of the present invention is attached.

As shown in FIG. 3, the separation pad 11 has an inverted V-shaped section including a central portion protruded above the sheet stacking surface of the pressure plate 10 and is attached to the pressure plate 10 in such a manner that a surface 11*a* of a front portion of the separation pad 11 is inclined with respect to the sheet stacking surface of the pressure plate 10 by an angle of θ. Further, the pick-up roller 8 is disposed in a confronting relation to the front surface 11*a* of the separation pad 11 inclined by the angle of θ.

Figure 4:
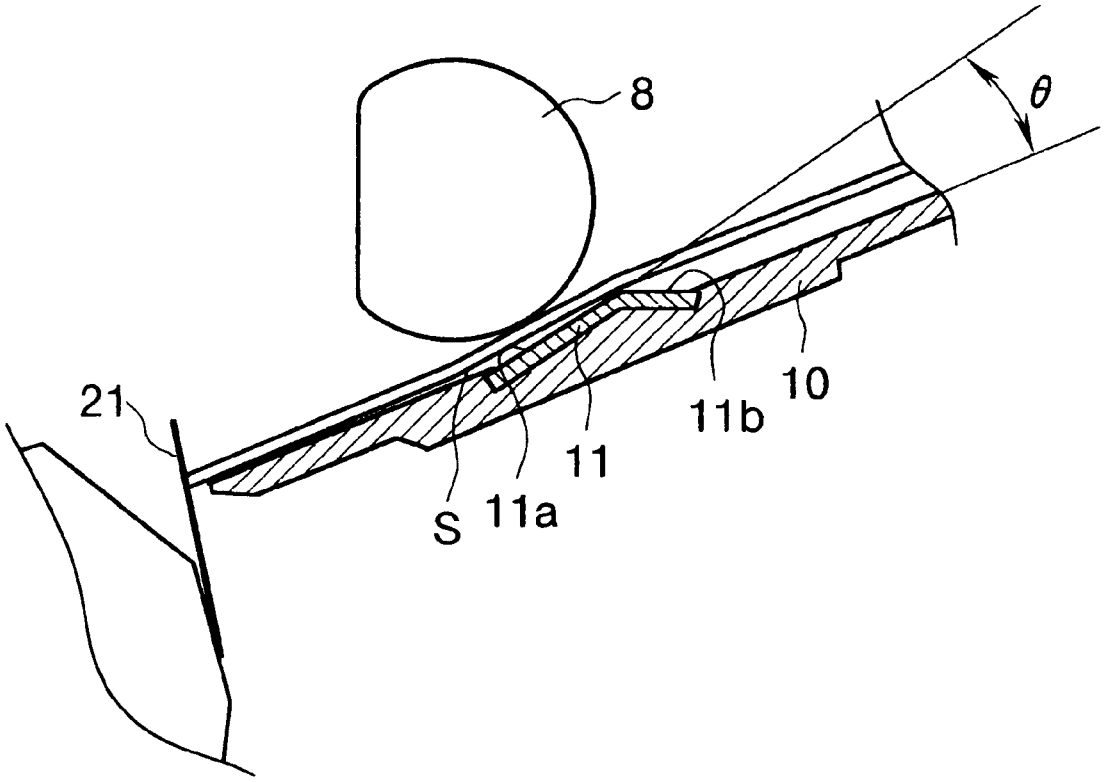
FIG. 4 is a view showing a condition that a sheet is being fed in the mechanism shown in FIG. 3.

With the arrangement of the separation pad 11 as mentioned above, in the sheet supplying operation, as shown in FIG. 4, the sheet urged against the rotating pick-up roller 8 by the biasing forces of the pressure springs 9 and fed out by the pick-up roller is guided along the front surface 11*a* by the angle of θ. Thus, the fed sheet is not floating and abuts against the plate member 21 at a substantially constant position along the sheet stack. Accordingly, the deformed amount of the plate member 21 is stabilized, thereby preventing the poor sheet supply such as double-feed.

A surface 11*b* of a rear (i.e. downstream) portion of the separation pad 11 is inclined in an direction opposite to the inclining direction of the front surface 11*a*, so that, when sheets are loaded on the pressure plate 10, even if the sheets are inserted along the sheet stacking surface of the pressure plate 10, the tip ends of the sheets cannot be caught by the rear end of the separation pad 11, and the sheets are surely loaded on the pressure plate since the tip ends of the sheets can easily ride over the separation pad 11 along the rear surface 11*b*.

Figure 7:
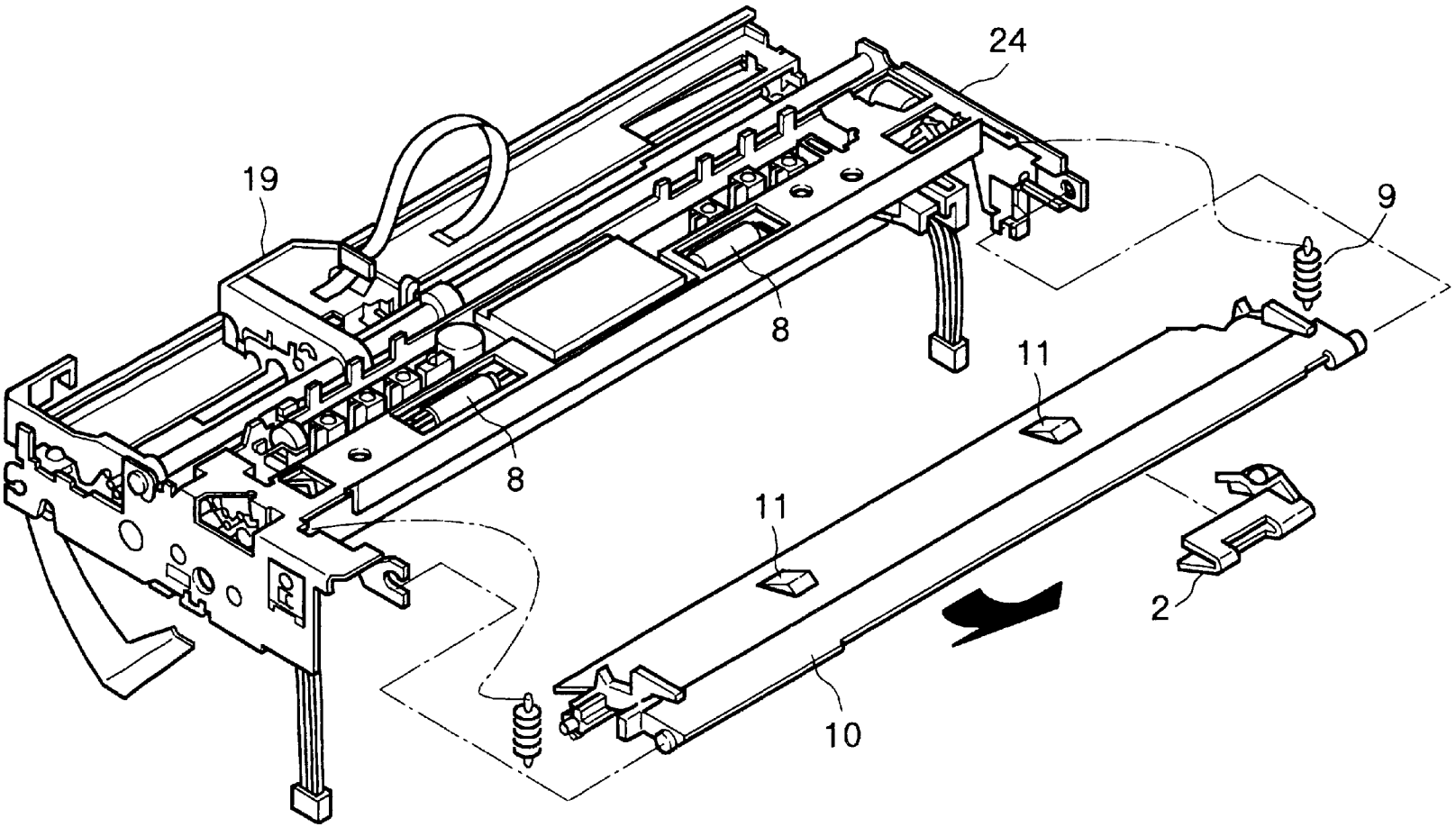
FIG. 7 is an exploded perspective view showing a relation between a pick-up roller and a separation pad of the recording apparatus of FIG. 1.

Further, as shown in FIG. 7, when a width of the separation pad 11 is set to be smaller than a width of the pick-up roller 8, due to the compactness of the separation pad, the apparatus can be made cheaper, and, the coefficient of friction of the separation pad 11 and the sheet can be made optimum and side edges of the separation pad 11 can contribute to separate the sheets, thereby obtaining the stable sheet separating ability.

Incidentally, although the separation pad 11 is formed from a plate-shaped elastic member made of rubber, artificial leather, cork or the like and is attached to the pressure plate while bending the plate-shaped elastic member, the plate-shaped elastic member may be previously bent.

Sheet Convey Portion

As shown in FIG. 2, at an upstream side of the recording portion C which will be described later, there are disposed an LF roller 13, and a pinch roller 14 positioned below the LF roller and urged against the LF roller by a coil spring 15. Further, at a downstream side of the recording portion C, there are disposed a pair of discharge rollers 20 arranged along a sheet conveying direction, and a pair of discharge pinch rollers 16 disposed below the respective discharge rollers 20 and urged against the respective discharge rollers by corresponding discharge coil springs 17.

With this arrangement, since the sheet is pushed upwardly by the pinch roller 14 and the discharge pinch rollers 16 up to lowermost points on peripheral surfaces of the LF roller 13 and of the discharger rollers 20. A distance between an upper surface of the sheet and a print head 18 provided in the recording portion C can always be kept constant regardless of the thickness of the sheet. This permits the stable printing.

Panel Board Portion

Figure 5:
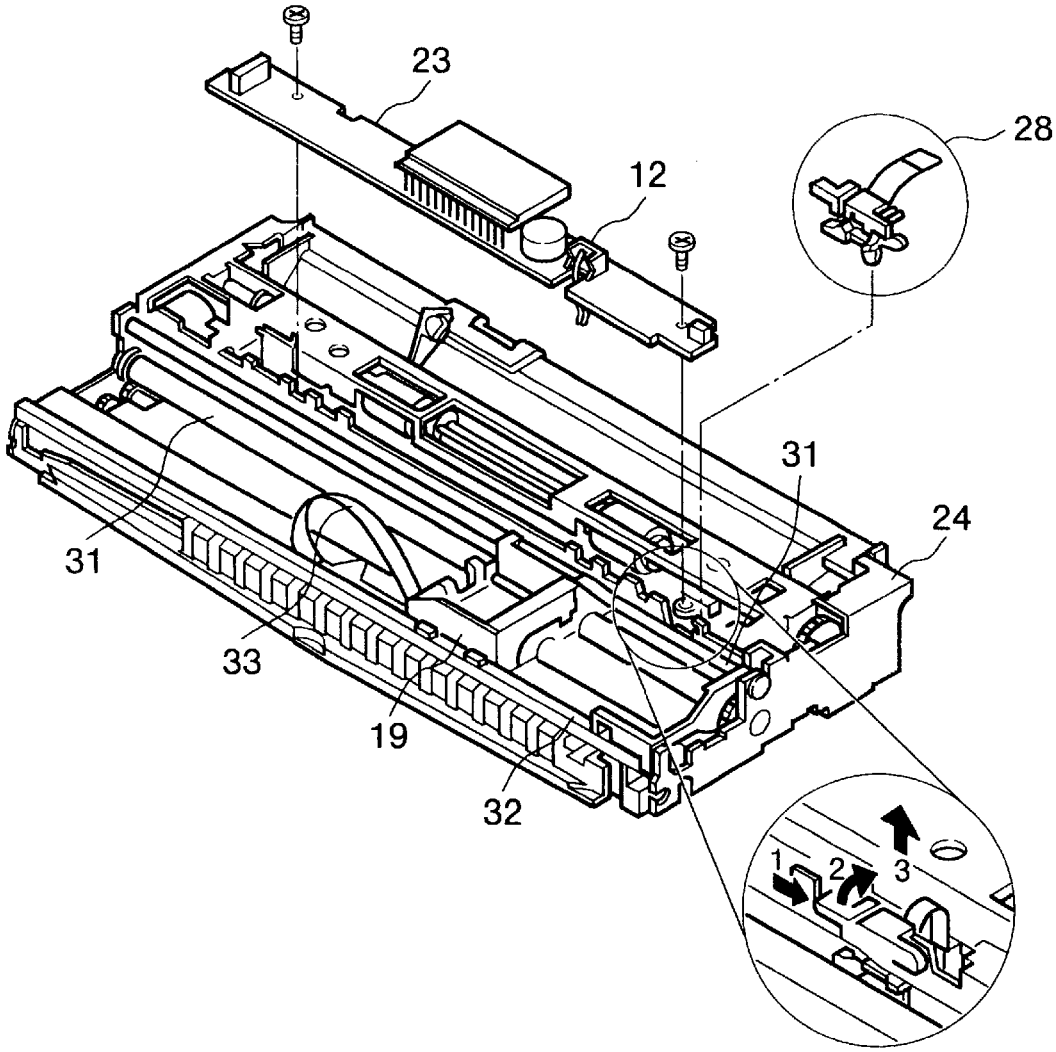
FIG. 5 is an exploded perspective view showing an internal structure of the recording apparatus of FIG. 1.
Figure 6:
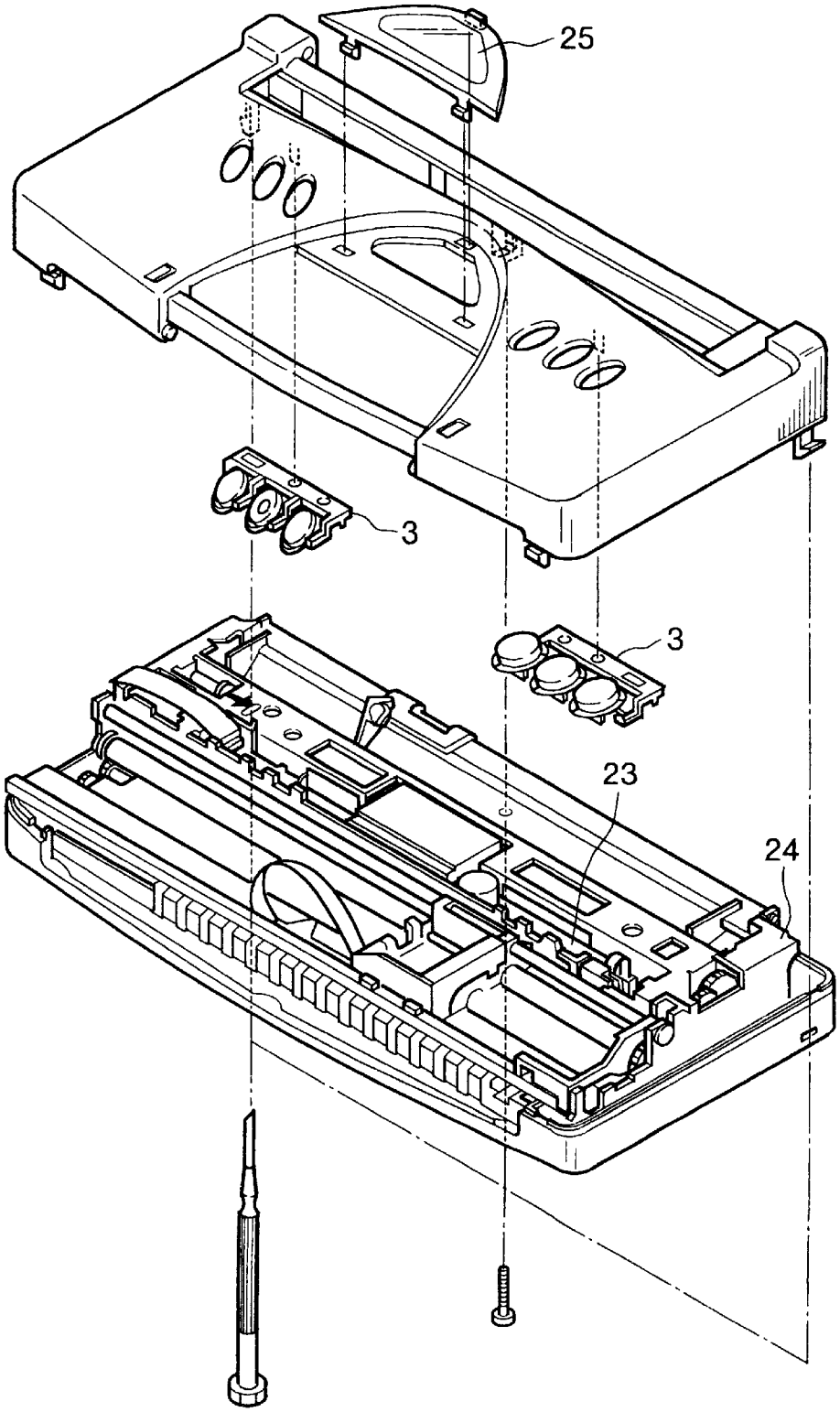
FIG. 6 is an exploded perspective view of the recording apparatus of FIG. 1.

As shown in FIGS. 5 and 6, at a downstream side of and above the sheet supply apparatus B, there is disposed a panel board 23 positioned near an operation surface. The panel board 23 is disposed immediately below the key-tops 3 so that force applied to the key-tops 3 are converted into electrical signals by detectors (not shown) on the panel board 23 for commanding the respective operations.

A paper sensor 12 is attached to the panel board 23, which paper sensor 12 serves to emit a detection signal in response to rotation of a paper sensor lever 12*a* protruded into a sheet path. Now, a relation between the paper sensor 12 and the LF roller 13.

The sheet fed out by the pick-up roller 8 and separated by the plate member 21 rotates the paper sensor lever 12*a*, with the result that the detection signal (for sheet) is outputted from the paper sensor 12. On the basis of this detection signal, by rotating the pick-up roller 8 by a predetermined amount, the sheet reaches the LF roller 13. In this case, by stopping the LF roller 13 or by rotating the LF roller in a reverse direction, the tip end of the fed sheet abuts against a nip between the LF roller 13 and the pinch roller 14 to form a loop in the sheet, thereby correcting the skew-feed of the sheet (registration operation).

When the sheet is conveyed on the basis of the detection signal of the paper sensor 12 in this way, the sheet can be fed out with a correct distance between the LF roller and the pick-up roller, thereby avoiding a danger that the sheet does not reach the LF roller (and, thus, the skew-feed cannot be corrected) or the sheet is execessively penetrated into the nip to fold the sheet.

Recording Portion C

As shown in FIGS. 2 and 5, a carriage 19 on which the print head 18 is mounted is slidably supported on a guide shaft 31 disposed on a chassis 24 along a longitudinal direction thereof and is driven by a carriage motor (not shown) and a carriage belt (not shown) in response to a recording signal. An HP sensor 28 for positioning the carriage 19 is attached to a carrier running portion of the chassis 24. The HP sensor comprises a photo-interrupter of permeable type which serves to detect the passing of a light shield plate of the carriage 19, thereby detecting the position of the carriage 19.

The print head 18 is electrically connected to a controller board 22 (FIG. 2) through a carriage flexible cable 32 so that the recording operation of the print head 18 is effected in response to a signal from the controller board 22.

The recording method of the print head 18 is an ink jet recording method in which a selected electro-thermal converter is energized in response to the recording signal and, by growing a bubble in ink by heating the ink to exceed film boiling by means of the energized electro-thermal converter, the ink is discharged from a discharge opening, thereby executing the recording.

Operation

Next, the operation in the first embodiment will be explained.

In the sheet supply apparatus B, the sheets stacked on the pressure plate 10 are fed out by the pick-up roller 8 to reach the plate member 21. When the plate member is deformed and the uppermost sheet rides over the plate member, the uppermost sheet is separated from the other sheets.

The separated and conveyed sheet is detected by the paper sensor 12, and, after detection, the sheet is conveyed by the predetermined amount, thereby correcting the skew-feed of the sheet by the LF roller 13.

After the sheet is conveyed toward the discharge roller 16 and the registration of the sheet is completed, the sheet is further conveyed; meanwhile, the recording is effected on the sheet by means of the print head 18. After recording, the sheet is discharged out of the recording apparatus through the discharge opening 6 by means of the discharge rollers 16.

Second Embodiment

Figure 8:
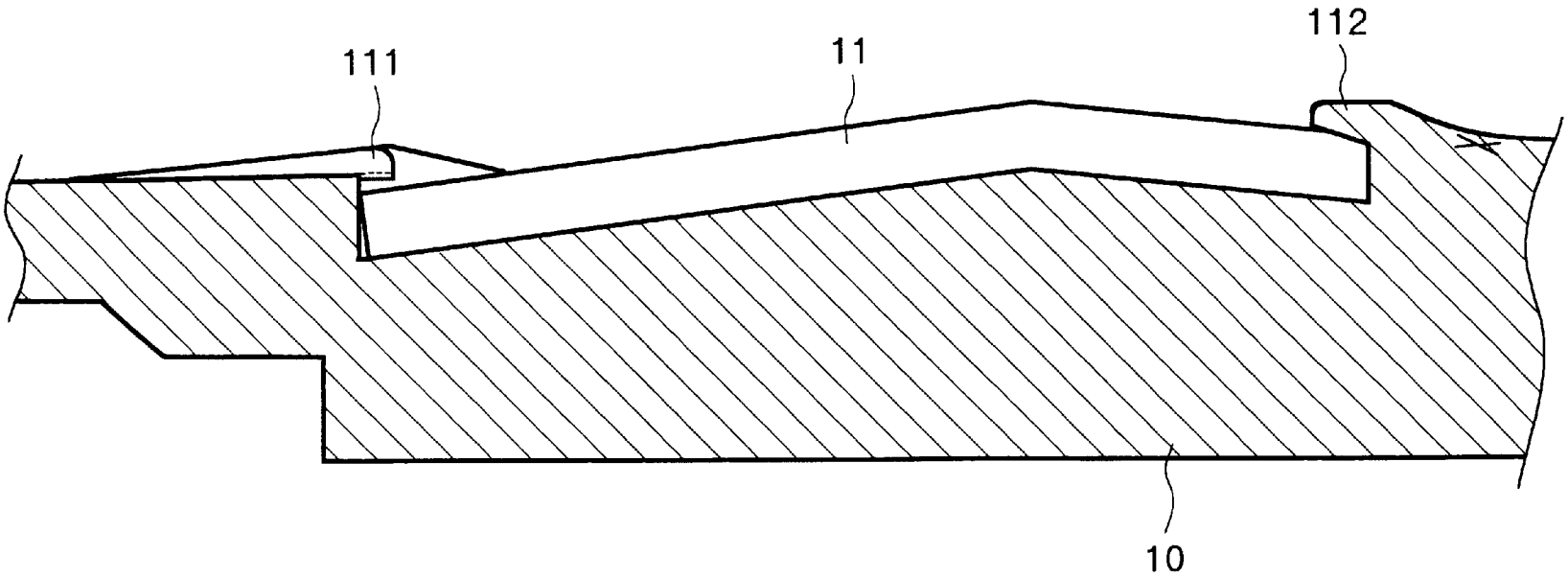
FIG. 8 is a sectional view showing a condition that a separation pad is attached, according to a second embodiment of the present invention.

Now, a second embodiment of the present invention will be explained with reference to FIGS. 7 and 8. Incidentally, explanation of the same elements as those in the first embodiment will be omitted.

The separation pad 11 is secured to the pressure plate 10 while deforming a plate-shaped member into an inverted V-shape. If the separation pad 11 is merely adhered to the sheet stacking surface of the pressure plate 10, when the sheet is fed out by the pick-up roller 8, the end of the sheet will be floating to float the entire sheet and/or the separation pad 18 itself will be peeled from the pressure plate. To avoid this, in the second embodiment, front and rear ends of the separation pad 11 are held by shelves 111, 112 formed on the pressure plate 10.

With this arrangement, when the sheet is fed out by the pick-up roller 8, it is possible to prevent the end of the sheet from floating and the separation pad 11 from being peeled, thereby achieving the stable sheet supply. Further, due to the provision of the shelf 112, when sheets are loaded on the sheet stacking surface of the pressure plate 10, the tip ends of the sheets are guided by the shelf 112, with the result that the tip ends of the sheets cannot be caught by the end of the separation pad 11, thereby preventing the folding of the sheets and achieving the smooth loading of the sheets.

Incidentally, since the operation of the sheet supply apparatus according to the second embodiment is the same as the first embodiment, explanation thereof will be omitted.

Third Embodiment

Figure 9:
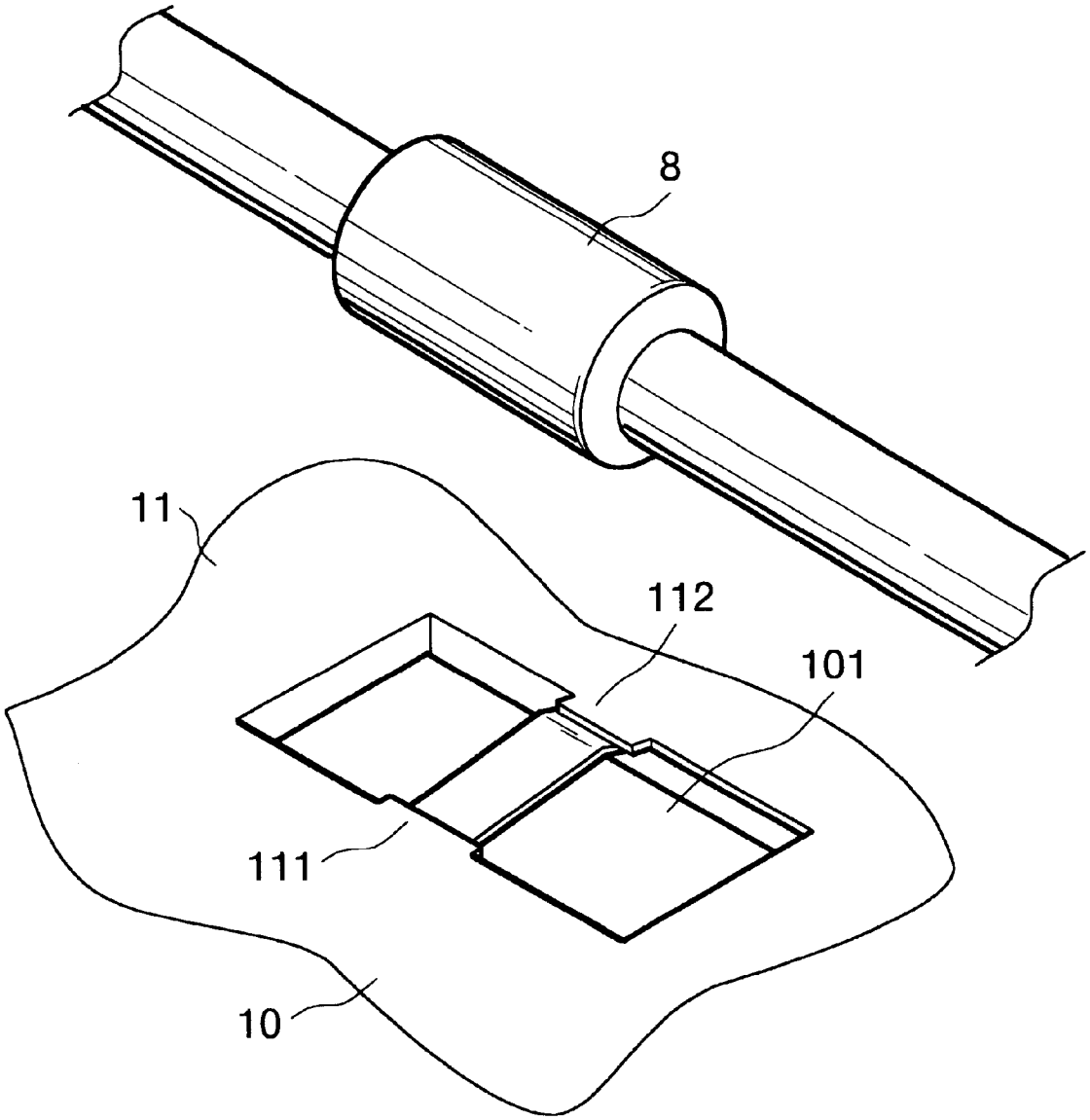
FIG. 9 is a perspective view showing a condition that a separation pad is attached, according to a third embodiment of the present invention.
Figure 10:
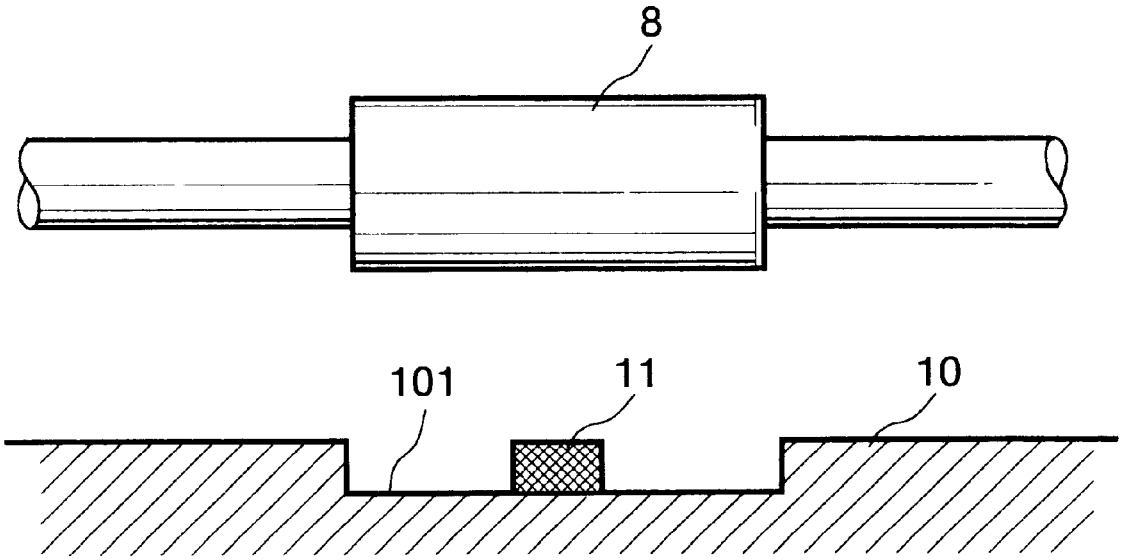
FIG. 10 is a sectional view showing the condition of FIG. 9.
Figure 11:
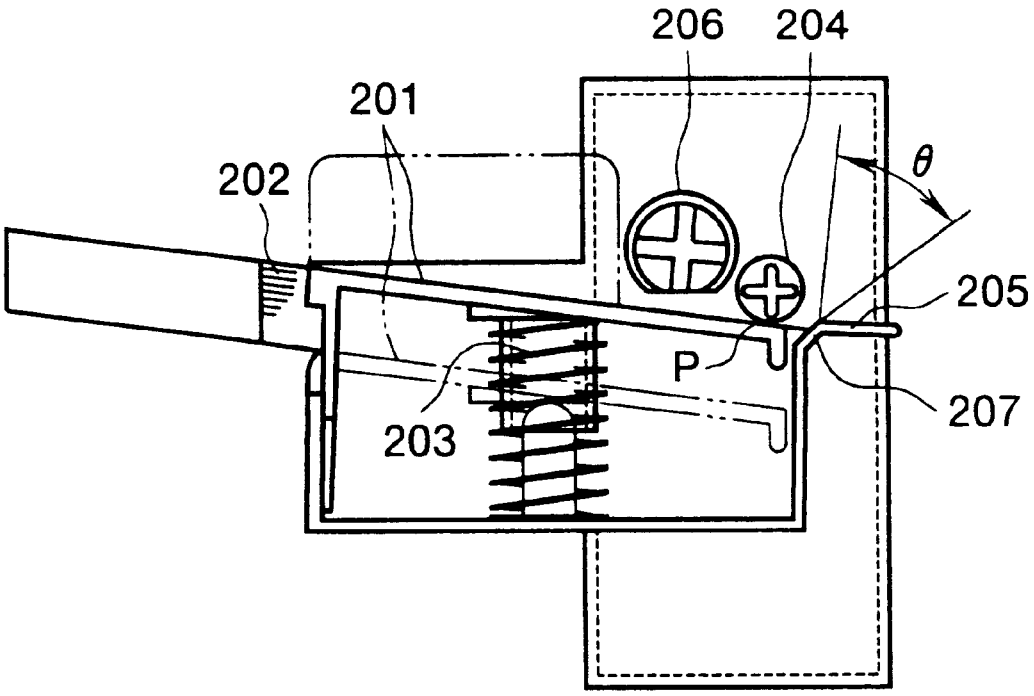
FIG. 11 PRIOR ART
FIG. 11 is a sectional view showing an example of a conventional sheet supply apparatus.
Figure 12:
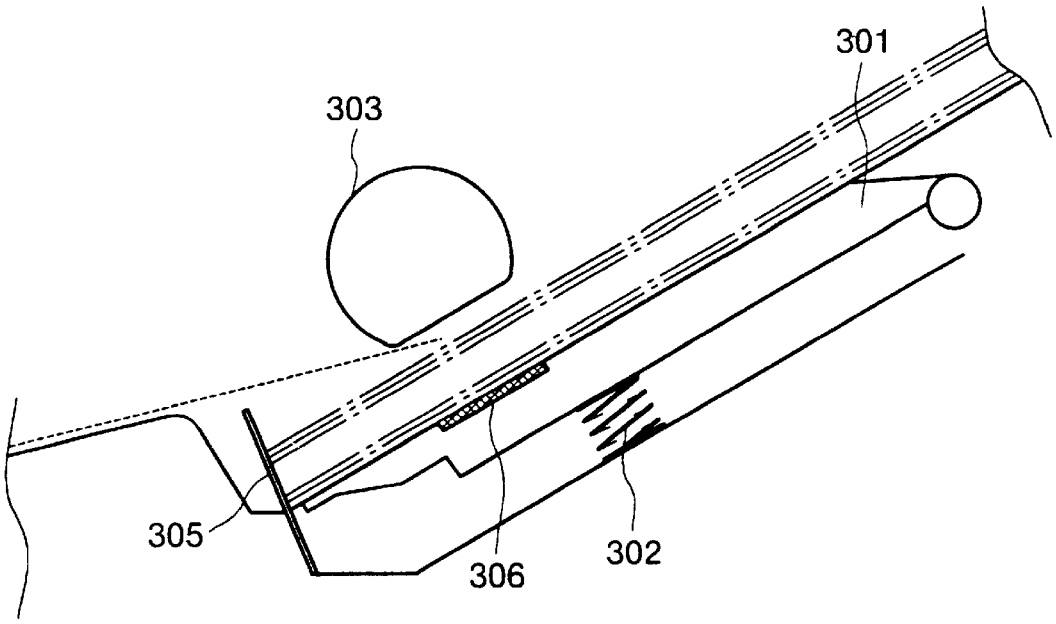
FIG. 12 PRIOR ART
FIG. 12 is a sectional view showing another example of a conventional sheet supply apparatus.
Figure 13:
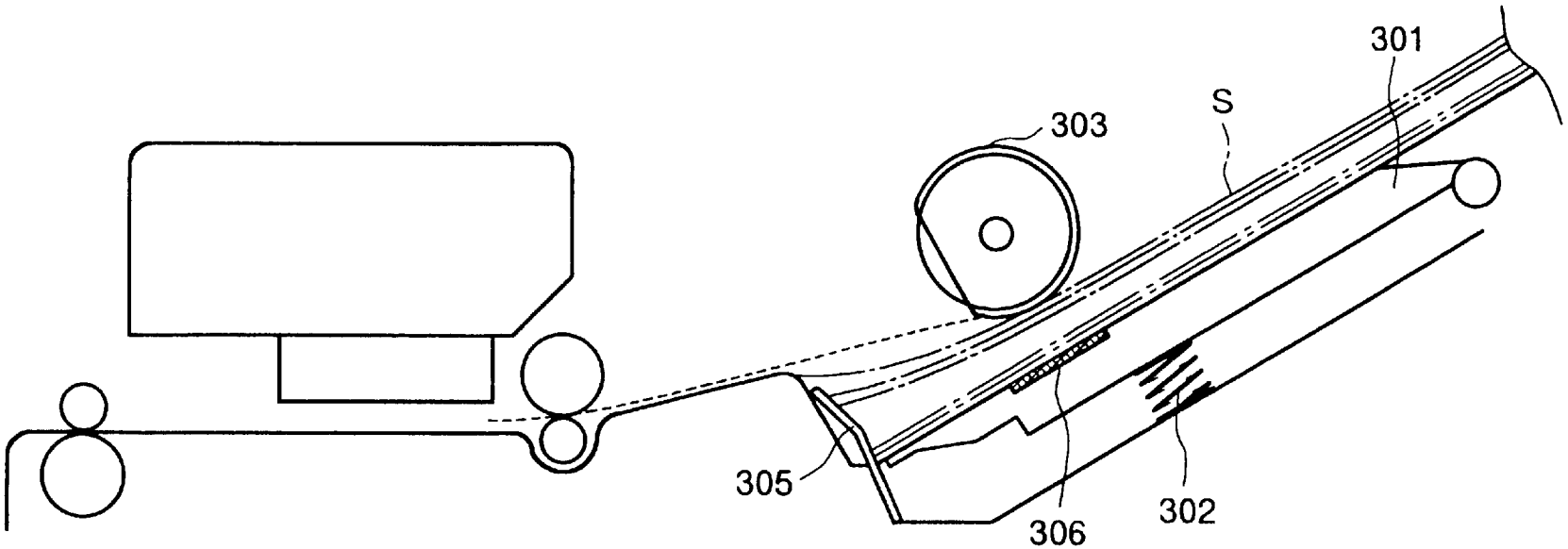
FIG. 13 PRIOR ART
FIG. 13 is a view showing an operation of the sheet supply apparatus of FIG. 12.

Next, a third embodiment of the present invention will be explained with reference to FIGS. 9 and 10. Incidentally, explanation of the same elements as those in the first embodiment will be omitted.

A recess 101 is formed in the pressure plate 10 in a confronting relation to the pick-up roller 8. The separation pad 11 is secured within the recess 101 while deforming it into an inverted V-shaped as is in the second embodiment. Incidentally, the front and rear ends of the separation pad 11 is held by the shelves 111, 112 formed on the pressure plate 10, thereby preventing the peeling of the separation pad.

Since the recess 101 has a dimension capable of receiving the pick-up roller 8, the pick-up roller 8 is not contacted with the sheet stacking surface of the pressure plate 10. Accordingly, when the sheets are urged against the pick-up roller 8 by the pressure springs 9, the load from the pressure springs 9 positively acts on the separation pad 11, with the result that the adequate friction force can be applied to the last sheet, thereby surely preventing the double-feed.

As mentioned above, according to the present invention, when the sheet is fed out by the sheet supply means, due to the particular configuration of the separation pad, the front end of the sheet can be prevented from floating. As a result, since the sheet can reach the proper position on the separation means to reduce the occurrence of the poor separation of the separation means, the stable sheet supply can be realized and the reliable sheet supply apparatus can be provided.

What is claimed is:

1. A sheet supply apparatus comprising:

sheet stacking means for supporting sheets on a sheet supporting surface of a sheet supporting member, wherein said sheet supporting member is movably mounted on an apparatus body and is urged by an urging means;

sheet supply means for feeding out the sheets supported by said sheet supporting member which is urged toward said sheet supply means by said urging means;

a separation plate member disposed on the apparatus body for separating the sheets fed out by said sheet supply means one by one, wherein said separation plate member is elastically deformed when the sheet fed out by said sheet supply means is abutted against said separation plate member and rides over said separation plate member; and a separation pad provided on said sheet supporting surface of said sheet stacking means opposite said sheet supply means, said separation pad protruding from said sheet supporting surface toward the sheets to frictionally contact the lower surface of the bottom-most sheet supported by said sheet stacking means, wherein said separation pad has an upper surface which is higher at a portion opposing said sheet supply means than a portion downstream thereof, in a sheet feeding direction, relative to the sheet supporting surface of said sheet stacking means, to urge an end of a sheet fed out by said sheet supply means to a substantially constant position of said separation plate member.

2. A sheet supply apparatus according to claim 1, wherein said separation pad is so shaped that the surface of said separation pad opposed to said sheet supply means is inclined to decrease a level from the upstream side to the downstream side along the sheet supplying direction.

3. A sheet supply apparatus according to claim 1, wherein said separation pad has an inverted V-shaped portion protruding upwardly from said sheet stacking surface and positioned centrally in the sheet supplying direction, and said sheet supply means is disposed in an opposed relation to a portion of said separation pad downstream of the inverted V-shaped portion.

4. A sheet supply apparatus according to claim 3, wherein a portion of said separation pad upstream of the inverted V-shaped portion is inclined to increase a level from the upstream side to the downstream side.

5. A sheet supply apparatus according to claim 1, wherein at least one of upstream and downstream ends of said separation pad in the sheet supplying direction is locked by a shelf. and said separation pad means is attached within said recess.

6. A sheet supply apparatus according to claim 3, wherein said separation pad is an elastic member attached to said sheet stacking means, said elastic member having an inverted V-shape.

7. A sheet supply apparatus according to one of claims 1 to 6, wherein said plate member is disposed in an opposed relation to tip ends of the sheets, so that, when said plate member is deformed elastically and angularly by abutting the sheet against said plate member to ride over it, said sheet is separated from the other sheets.

8. A sheet supply apparatus according to claim 7, wherein said sheet supply means is a pick-up roller.

9. A sheet supply apparatus comprising:

sheet stacking means for supporting sheets on a sheet supporting surface of a sheet supporting member, wherein said sheet supporting member is movably mounted on an apparatus body and is urged by an urging means;

sheet supply means for feeding out the sheets supported by said sheet supporting member which is urged toward said sheet supply means by said urging means;

a separation plate member disposed on the apparatus body for separating the sheets fed out by said sheet supply means one by one, wherein said separation plate member is elastically deformed when the sheet fed out by said sheet supply means is abutted against said separation plate member and rides over said separation plate member; and a separation pad provided on said sheet supporting surface of said sheet stacking means opposite said sheet supply means, said separation pad having a contact surface which contacts the sheets, said separation pad protruding from said sheet supporting surface toward the sheets to frictionally contact the lower surface of the bottom-most sheet supported by said sheet stacking means, wherein said sheet separation pad has an upper surface which is higher at a portion opposing said sheet supply means than a portion downstream thereof, in a sheet feeding direction, relative to the sheet supporting surface of said sheet stacking means, to urge an end of a sheet fed out by said sheet supply means to a substantially constant position of said separation plate member, and wherein a width of said contact surface of said separation pad is less than a width of said sheet supply means.

10. A sheet supply apparatus according to claim 9, wherein said contact surface of said separation pad protrudes from said sheet supporting surface toward said sheet supply means.

11. A sheet supply apparatus according to claim 10, wherein said separation pad is disposed within a recess formed in said sheet supporting surface and capable of receiving said sheet supply means, and said separation pad is disposed so that said contact surface protrudes above a bottom surface of said recess.

12. A sheet supply apparatus according to one of claims 1 to 5, 6 and 9 to 11, wherein said sheet supply means is a pick-up roller.

13. A recording apparatus comprising:

sheet stacking means for supporting sheets on a sheet supporting surface of a sheet supporting member, wherein said sheet supporting member is movably mounted on an apparatus body and is urged by a urging means;

sheet supply means for feeding out the sheets supported by said sheet supporting member which is urged toward said sheet supply means by said urging means;

a separation plate member disposed on the apparatus body for separating the sheets fed out by said sheet supply means one by one, wherein said separation plate member is elastically deformed when the sheet fed out by said sheet supply means is abutted against said separation plate member and rides over said separation plate member;

recording means for executing recording on the sheet separated by said separation plate member; and a separation pad provided on said sheet supporting surface of said sheet stacking means opposite said sheet supply means, said separate pad protruding from said sheet supporting surface toward the sheets to fractionally contact the lower surface of the bottom-most sheet supported by said sheet stacking means, wherein said sheet separation pad has an upper surface which is higher at a portion opposing said sheet supply means than a portion downstream thereof, in a sheet feeding direction, relative to the sheet supporting surface of said sheet stacking means, to urge an end of a sheet fed out by said sheet supply means to a substantially constant position of said separation plate member.

14. A recording apparatus according to claim 13, wherein said recording means is an ink jet recording means having an electro-thermal converter which is energized in response to a recording signal, and, by growing a bubble in ink by heating the ink to exceed film boiling by said electro-thermal converter, the ink is discharged from a discharge opening of said ink jet recording means, thereby executing the recording on the sheet.

* * * * *

UNITED STATES PATENT AND TRADEMARK OFFICE

CERTIFICATE OF CORRECTION

PATENT NO. : 5,951,003

DATED : September 14, 1999

INVENTOR(S) : TAKASHI NOJIMA ET AL.

It is certified that error appears in the above-identified patent and that said Letters Patent is hereby corrected as shown below:

Title page,

AT [56] REFERENCES CITED

FOREIGN PATENT DOCUMENTS

Attorney, Agent or Firm, "Fitzpatrick Cella Harper & Scinto" should read --Fitzpatrick, Cella, Harper & Scinto--.

COLUMN 5

Line 6, "waiting" should read --weighting--.

COLUMN 8

Line 29, "the" should read --a--.

COLUMN 9

Line 15, "and said separation pad means is attached within said" should be deleted; and Line 16, "recess." should be deleted.

UNITED STATES PATENT AND TRADEMARK OFFICE

CERTIFICATE OF CORRECTION

PATENT NO. : 5,951,003

DATED : September 14, 1999

INVENTOR(S) : TAKASHI NOJIMA ET AL.

It is certified that error appears in the above-identified patent and that said Letters Patent is hereby corrected as shown below:

COLUMN 10

Line 15, "1 to 5, 6" should read --1 to 6--.

Signed and Sealed this

Twenty-fifth Day of July, 2000

*Attest:*

*Attesting Officer*

Q. TODD DICKINSON

*Director of Patents and Trademarks*